United States Patent [19]

Durville

[11] Patent Number: 4,615,189

[45] Date of Patent: Oct. 7, 1986

[54] WARP KNITTING MACHINE, PARTICULARLY GALLOON CROCHETING MACHINE

[75] Inventor: Gerard Durville, Gipf-Oberfrick, Switzerland

[73] Assignee: Textilma AG, Switzerland

[21] Appl. No.: 743,709

[22] PCT Filed: Sep. 27, 1984

[86] PCT No.: PCT/CH84/00156

§ 371 Date: Jun. 5, 1985

§ 102(e) Date: Jun. 5, 1985

[87] PCT Pub. No.: WO85/01526

PCT Pub. Date: Apr. 11, 1985

[30] Foreign Application Priority Data

Oct. 6, 1983 [CH] Switzerland ..... 5433/83

[51] Int. Cl.[4] ..... D04B 23/00

[52] U.S. Cl. ..... 66/204; 66/207

[58] Field of Search ..... 66/203, 204, 207

[56] References Cited

U.S. PATENT DOCUMENTS 2,423,433 7/1947 Amidon ..... 46/207

3,987,648 10/1976 Fillmor et al. ..... 66/207

FOREIGN PATENT DOCUMENTS 43842 3/1966 German Democratic Rep. ... 66/207

*Primary Examiner*—Ronald Feldbaum

*Attorney, Agent, or Firm*—McCormick, Paulding & Huber

[57] ABSTRACT

Longitudinal weft guides, as well as other weft guides and/or thread guides are placed relative to the hook needles and to the corresponding thread guides in a knitting machine. In order to simply to drive thereof, the drive devices for the bars (22,24) of the longitudinal weft guides as well as the drive device for the bar (32) of the thread guides are arranged together on one side of the machine frame and are combined. To this end, a common drive shaft is provided for oscillating levers of the drive to the longitudinal weft guides and another oscillating lever for the thread guides.

4 Claims, 7 Drawing Figures

WARP KNITTING MACHINE, PARTICULARLY GALLOON CROCHETING MACHINE

The invention consists of a warp knitting machine, in particular a galloon crocheting machine.

A warp knitting machine, in particular a galloon crocheting machine, of the above-mentioned type is described, for example, in German Patent OS 27 58 421. Oscillating levers serve as drives for the rods of the longitudinal weft guides, and the levers are arranged at opposite sides of the machine frame and are driven by means of eccentrics, as is described in the example of German Patent OS 27 21 024. These other rods, which do not serve for driving the longitudinal weft guides, but instead for weft guides of another type and/or for the thread guides are operated by driving devices which are positioned on the other side of the machine frame. Therefore, it is necessary to have two drives at opposite sides of the machine frame for driving the rods, and due to this, on the one hand, the manufacture of such knitting machines becomes expensive, and on the other hand, the adjustment is difficult, since the adjustment of the drive devices must be accomplished on two different sides of the machine frame.

It is an object of the present invention to construct a warp knitting machine, in particular a galloon crocheting machine of the foregoing type, so that its manufacture is more cost-effective and its operation is simpler. This object is achieved by the present invention. In this regard the driving device for at least one of the rods for the weft guides and/or thread guides is located on the same side of the machine frame as the drive device for the rods of the longitudinal weft guides. With these drive devices combined in this manner, a substantial saving in components is achieved, and the adjustment of the drives is made simpler since it can be performed from one side.

It is conceivable that a single drive shaft would suffice for the drive device of the bars of the weft guides and/or thread guides. This drive shaft is drivingly connected to the drive devices for the rods of the longitudinal weft guides. It is preferable, however, if the drive shaft for the drive devices of the longitudinal weft drives is employed simultaneously for driving the drive devices of the remaining weft guides and/or thread guides. One particularly simple and compact construction results if the warp knitting machine is formed with two oscillating levers as the drive devices for the bars of the longitudinal weft guides. The oscillating lever of the drive device for the remaining weft guides and/or thread guides can be equipped with a follower which is held against the eccentric of the drive shaft by spring tension. Preferably, however, an embodiment is adopted, where an oscillatory guide for the oscillating lever is provided in both directions.

The oscillating lever of the drive device for the remaining weft guides and/or thread guides can be designed as a one-arm lever to the free end of which the coupling bar is connected to transmit the back and forth movement to the bar. In this manner, this coupling bar can be fastened by means of a bolt in an oblong hole. Preferably, this is accomplished with a two-armed lever since then the adjustment of the operating length of the lever can be made at the arm to which the coupling bar connects. Here too, for example, a connecting rod joined with the drive shaft can be fastened likewise by means of a bolt in an oblong hole of the oscillating lever.

In this embodiment of the oscillating lever, a two-armed lever provides a further advantage in that the end of the oscillating arm to be joined with the coupling bar can be improved with various other possibilities, including multiple connecting points for the bar. By this means, a shifting of the connecting point for the coupling bar is possible, so that the bars movable back and forth in various guides can be fixed to the oscillating arms of the knitting machine.

The new configuration of the knitting machine is adapted in particular for the manufacture of simple work products with continuous stitches, in particular for the manufacture of ribbons with interwoven elastic threads, for example, rubber threads.

An exemplary embodiment of the warp knitting machine of the present invention, in particular the galloon crocheting machine is further described hereinafter with the aid of drawings in which.

Figure 3:
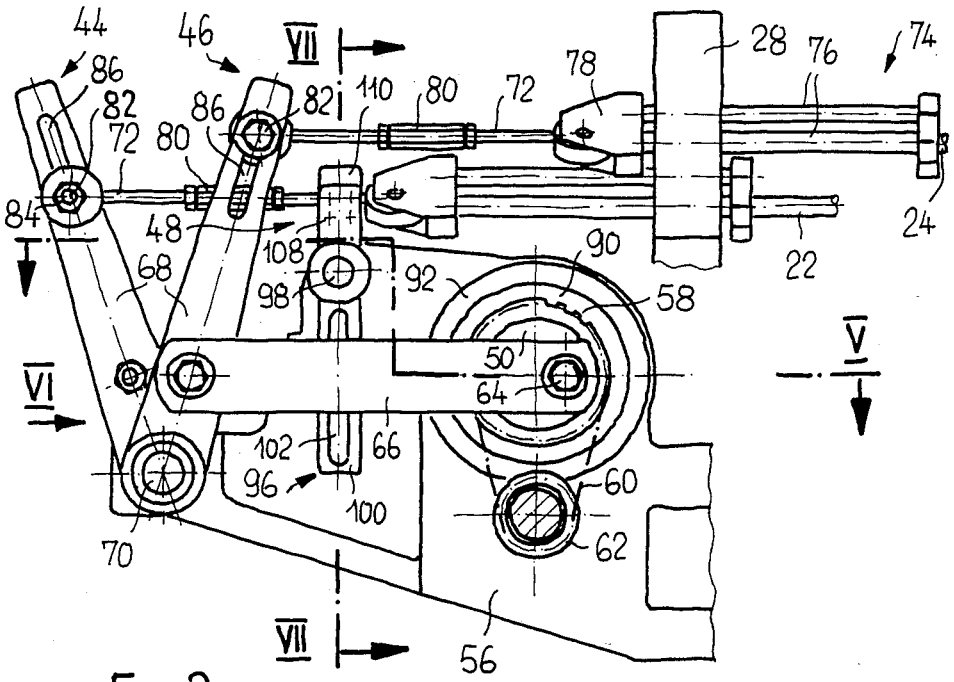
FIG. 3 illustrates the drive for the longitudinal weft guides as well as the weft guides and/or thread guides in which the coupling bar for the weft guides and/or thread guides is omitted, the view being taken in a direction opposite to the knitting.
Figure 4:
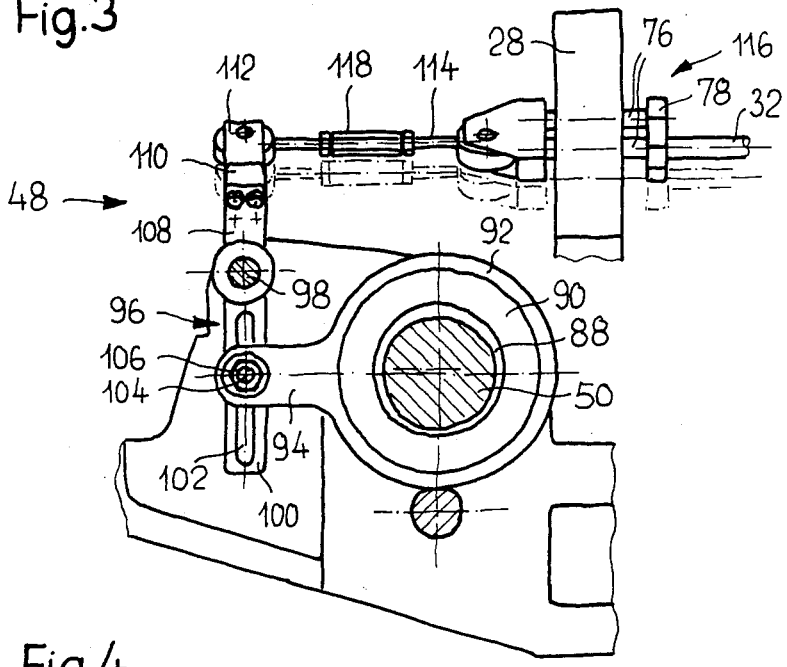
FIG. 4 is a sectional view as seen along the section line IV—IV of FIG. 1, and shows in detail the drive device for the bars of the weft guides and/or thread guides for the drive of FIG. 3.
Figure 5:
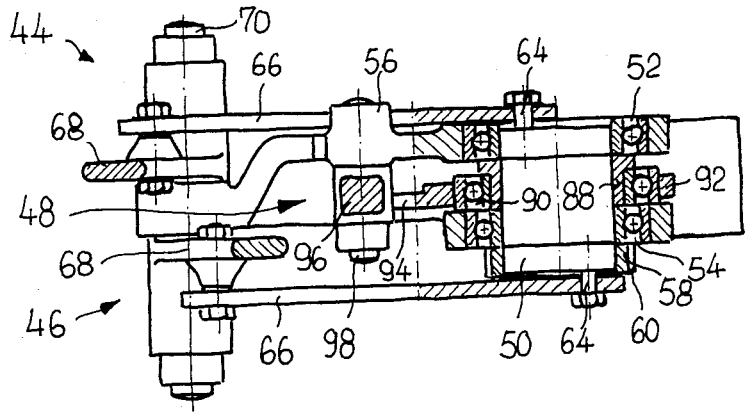
FIG. 5 is a sectional view of the drive in FIG. 3 as seen along the sectioning line V—V.
Figure 6:
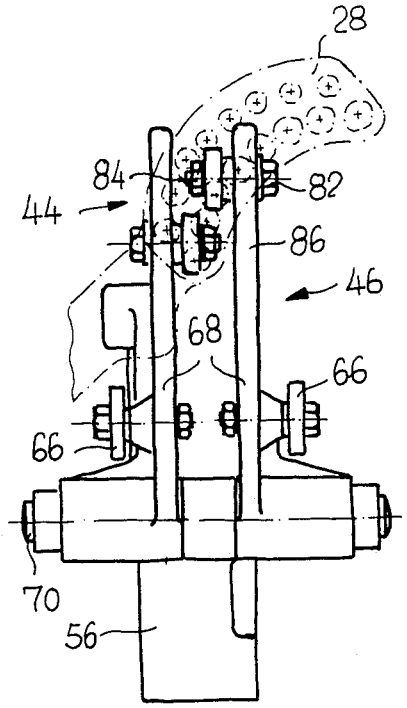
Figure 7:
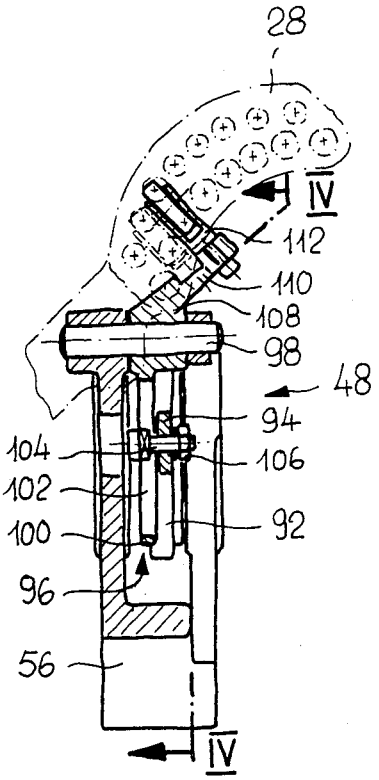

FIG. 6 is a side elevation view of FIG. 3 as seen in the direction VI, and illustrates the drive device for the longitudinal weft guides—without the drive device for the other weft guides and/or thread guides, and FIG. 7 is a sectional view of FIG. 3 as seen along the section line VII—VII and illustrates the drive device for the weft guide and/or thread guides—without the drive device for the longitudinal weft guides.

Figure 1:
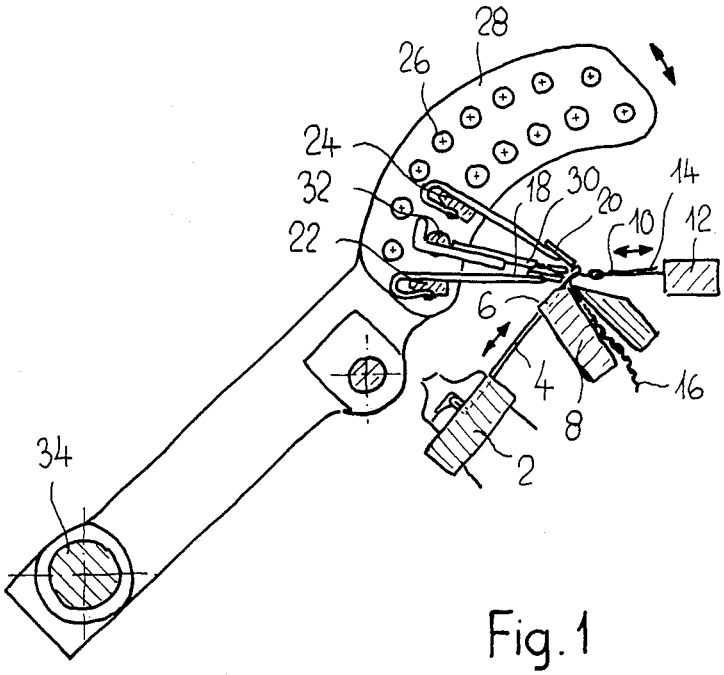
FIG. 1 is a side elevation of the work area of a galloon crocheting machine illustrated schematically.

FIG. 1 shows the operative components at the knitting station of a galloon crocheting machine similar to the embodiment of the galloon crocheting machine according to German Patent OS 27 58 421. A series of hook needles 4 are arranged on a bar 2 which needles lie parallel to one another and project forwardly. The hook needles 4 can be combined in various groups, and are moved back and forth in their longitudinal direction in a manner not illustrated. At the forward region, the hook needles are guided in a groove of a take-up bar 8. On the side opposite the needles 4, a series of thread guides 10 are arranged, which are held likewise in a bar 12 which performs a back and forth movement transverse to the direction of the thread guides 10 in order to insert from time to time a guided thread 14 in the corresponding hook needle 4. Upon retraction of the needle 4, a stitch existing on the needle is taken up and a new stitch is formed. The knitting 16 is discharged downwardly.

Further, two longitudinal weft guides 18,20 are operative at the work station and are actually connected to bars 22,24. The bars are actually slidably mounted in a guide 26 of an oscillating arm 28 for back and forth displacement. The longitudinal weft guides 18,20 actually serve to insert a weft thread at least along one portion of the width of the knitting in order to connect the individually knitted threads with one another. A set of thread guides 30 also exists at the knitting station, and the guides are likewise fastened to a common bar 32 which likewise is slidably mounted in a guide 26 of the oscillating arm 28. The thread guide 30 serves in the foregoing example to interweave a single thread longitudinal into the chains formed by the knitting. The oscillating arm 28 is pivoted back and forth about an axis 34 by means of a drive device, which is not illustrated, in order to bring the longitudinal weft guides 18,20 and the thread guides 30 into the necessary position from time to time for drawing of the threads by means of the hook needles 4.

Figure 2:
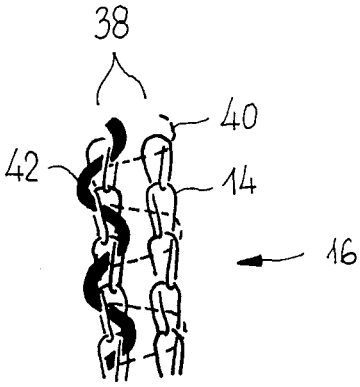
FIG. 2 is a top plan view showing a section of the knitting.

FIG. 2 shows a section of the knitting 16 which can be manufactured with a galloon crocheting machine according to FIG. 1. The knitted stitches or chains 38 are produced by means of the hook needles 4. The longitudinal weft guides 18 serve to insert the weft threads 40 which produce the connection between the two individually knitted chains 38. In the example illustrated, the weft thread only runs between the two chains 38; however, it can run over several chains. Finally, a thread 42, for which the thread guide 30 serves as a guide, is interwoven in a chain 38. The thread 42 is, for example, an elastic thread, in particular a rubber thread, whereby it is possible to manufacture a highly elastic knitted product.

FIGS. 3–7 show the driving devices 44,46 for driving the longitudinal weft guides 18,20 and the drive device 48 for driving the thread guides 30. A common drive shaft is journaled by means of ball bearings 52,54 in a frame 66 for rotation. The drive shaft 50 includes a gear 58 which is driven by means of a toothed belt 60 that runs over a driven gear 62.

Crank pins 64 are actually screwed into the end of the drive shaft 50 and carry connecting rods 66, which are connected to oscillating levers 68. The oscillating levers 68 are rotatably mounted at one end on an axis 70. At the other end, the levers are actually joined to coupling links 72 which are connected with guide members 74. The bars 22,24 are connected to these guide members. Each guide member is formed by two rods 76 which run through two guides 26 of the oscillating arms 28 and are connected with one another at the ends by means of joining members 78. The rods 76 serve the purpose of preventing the bars from wobbling. The coupling links 72 are separate and are held together by sleevelike adjusting nuts 80 which consist of oppositely threaded components in order to be able to adjust the length of the links. Besides, the coupling links 72 are actually fastened in oblong holes 86 by means of threaded bolts 82 and lock nuts 84 so that the effective length of the oscillating levers 68 can be adjusted.

The drive device 48 for the bars 32 of the thread guides 30 is formed by an eccentric ring 88 which is fastened to the drive shaft 50 between the ball bearings 52,54. A ball bearing 90 is mounted to the eccentric ring 88 and a connecting rod 94 is fastened to the bearing race 92 of the bearing. The other end of the connecting rod 94 is connected with a two-armed oscillating lever or rocker arm 96 which is rotatably mounted to the frame 56 by means of a bolt 98. The arm 100 of the lever 96 joined with the connecting rod 94 has an oblong hole 102 so that the moment arm of the connecting rod 94 is adjustable by means of a threaded bolt 104 and a lock nut 106.

A lever arm 110 is arranged on the other arm 108 of the oscillating lever 96, and various fastening positions for the fastener 112 of the coupling link 114 are located on the arm 110. The coupling link 114 is again joined with a guide member 116 to which the bar 32 for the thread guides 30 is connected. The guide member is again formed to correspond with the guide members 74 of the bars 22,24 for the longitudinal weft guides 18,20. Additionally, the coupling link 114 is also separated whereby the individual parts can be provided with opposite threading and are joined together with a corresponding adjustable nut in order to be able to adjust the length of the coupling link 114. With the aid of various fastening positions on the lever arm 110, it is possible to set the bars 32 for the thread guides 30 in various guides 26 of the oscillating arm 28 as is illustrated by phantom lines in FIGS. 4 and 7.

I claim:

1. A warp knitting machine having a series of movable hook needles, a series of thread guides movable relative to the needles, longitudinal weft guides secured to guide bars that move back and forth in a direction parallel to the series of hook needles, and other weft and thread guides, a common drive device for the bars to which longitudinal weft guides are secured including a drive shaft with eccentrics to which oscillating levers are joined by means of connecting rods, the levers being in turn joined by connecting links with the longitudinal weft guide bars, wherein the improvement comprises: a further eccentric (88) mounted on the drive shaft between the eccentrics for the connecting rods (66) connected to the oscillating levers (68) for the longitudinal weft guides (18,20), a rocker arm (96) disposed in a plane between the oscillating levers (68) for the longitudinal weft guides, the rocker arm being connected to at least one of the guide bars (32) for the other weft guides and thread guides (30) for driving the guides and a connecting rod (94) extending between the eccentric (88) and the rocker arm (96) for driving said at least one of the guide bars (32) from the common drive shaft (50).

2. A warp knitting machine as described in claim 1 wherein the rocker arm (96) and the one end of the connecting rod (94) joined with the rocker arm have an adjustable connecting point whereby the effective moment arm of the rocker arm (96) is adjustable.

3. A warp knitting machine as described in claim 2 wherein connecting links (72) interconnect the oscillating levers (68) and the guide bars (22,24) for the longitudinal weft guides, and the connections between the links (72) and the levers (68) are adjustable to adjust the effective length of the oscillating levers.

4. A warp knitting machine as described in claim 1 wherein connecting links (72) interconnect the oscillating levers (68) and the guide bars (22,24) for the longitudinal weft guides, and the connections between the links (72) and the levers (68) are adjustable to adjust the effective length of the oscillating levers.

* * * * *